US012312132B2

(12) United States Patent
Moreira

(10) Patent No.: US 12,312,132 B2
(45) Date of Patent: May 27, 2025

(54) COLLAPSIBLE BOX

(71) Applicant: Daniel Moreira, Elizabeth, NJ (US)

(72) Inventor: Daniel Moreira, Elizabeth, NJ (US)

( * ) Notice: Subject to any disclaimer, the term of this patent is extended or adjusted under 35 U.S.C. 154(b) by 0 days.

(21) Appl. No.: 18/727,689

(22) PCT Filed: Jan. 10, 2023

(86) PCT No.: PCT/US2023/060399

§ 371 (c)(1),
(2) Date: Jul. 10, 2024

(87) PCT Pub. No.: WO2023/133591

PCT Pub. Date: Jul. 13, 2023

(65) Prior Publication Data

US 2025/0108954 A1 Apr. 3, 2025

Related U.S. Application Data

(60) Provisional application No. 63/361,594, filed on Jan. 10, 2022.

(51) Int. Cl.
*B65D 5/36* (2006.01)
*B65D 5/46* (2006.01)

(52) U.S. Cl.
CPC ..... *B65D 5/3628* (2013.01); *B65D 5/46096* (2013.01)

(58) Field of Classification Search
CPC ..... B65D 5/3628; B65D 5/46096; B65D 5/3678; B65D 5/4266; B65D 2525/288; B65D 5/3621; A45C 7/0036; Y02W 30/80

(Continued)

(56) References Cited

U.S. PATENT DOCUMENTS 1,668,800 A 5/1928 Bonfield
2,331,582 A 10/1943 Trost (Continued)

FOREIGN PATENT DOCUMENTS

DE 202005009774 U1 10/2005
EP 0800998 A1 10/1997

(Continued)

OTHER PUBLICATIONS

Written Opinion of the International Search Authority, May 12, 2023, for International Application No. PCT/US23/60399.

(Continued)

*Primary Examiner* — Christopher R Demeree
(74) *Attorney, Agent, or Firm* — Rosenthal IP Law; Lawrence Rosenthal

(57) ABSTRACT

A collapsible box is provided that facilitates folding of the box into a flattened configuration having a profile the same size as the sides of the box. The box includes two main face panels, two side panels each having a vertical crease, a lower bottom panel having a longitudinal crease and cutouts adjacent to the side panels, bottom flaps attached to the lower edges of the side panels, and an upper bottom panel affixed to the lower edge of a main face panel that folds over the lower bottom panel and bottom flaps to provide structural rigidity. The box can be easily collapsed by raising the upper bottom panel and bottom flaps, and pushing the creases on the side panels and lower bottom panel inward. The box can optionally be formed from a single blank of cardboard or similar material, and can optionally be provided with handles or a lid.

20 Claims, 6 Drawing Sheets

(58) Field of Classification Search
USPC ..... 229/117.01, 108.1, 117.07, 120.31, 917, 229/942
See application file for complete search history.

(56) References Cited

U.S. PATENT DOCUMENTS

| | | | | |
|---|---|---|---|---|
| 3,565,325 | A | 2/1971 | Pugsley | |
| 4,034,909 | A | 7/1977 | Toda | |
| 4,094,458 | A | 6/1978 | Nelson, Jr. | |
| 5,011,071 | A * | 4/1991 | Lopez | B65D 5/0281 229/117 |
| 5,474,230 | A | 12/1995 | Yotukura | |
| 6,016,952 | A * | 1/2000 | Smith | B65D 5/4208 229/117 |
| 6,189,776 | B1 * | 2/2001 | Smith | B65D 5/10 229/117 |
| 2001/0032873 | A1 * | 10/2001 | Grueneberg | B65D 5/32 229/120.31 |
| 2021/0024247 | A1 | 1/2021 | Sollie et al. | |
| 2022/0380083 | A1 * | 12/2022 | Sollie | B65D 5/4266 |

FOREIGN PATENT DOCUMENTS

| | | | |
|---|---|---|---|
| FR | 9700601 | | 7/1998 |
| GB | 718448 | A | 11/1954 |
| WO | 2005068305 | A1 | 7/2005 |

OTHER PUBLICATIONS

International Search Report, May 12, 2023, for International Application No. PCT/US23/60399.

* cited by examiner

COLLAPSIBLE BOX

CROSS-REFERENCE TO RELATED APPLICATION(S)

The present application relates to and claims priority from International Patent Application No. PCT/US2023/060399, filed Jan. 10, 2023, and from U.S. Provisional Patent Application Ser. No. 63/361,594 filed Jan. 10, 2022, the disclosures of which are incorporated herein by reference in their entirety.

FIELD OF THE DISCLOSURE

The present disclosure relates generally to foldable or collapsible boxes, and specifically to such boxes that can be collapsed to a size not larger than the size of one side panel of the box and easily reopened to a rigid uncollapsed state.

BACKGROUND INFORMATION

Boxes are ubiquitous and are used for many of purposes, such as for storage, shipping, enclosing consumer goods, and the like. Because of the variety of uses, boxes come in a variety of sizes and shapes. The most common types of boxes have rectangular sides, which provide for easy stacking with no wasted volume between them. Boxes also come in many sizes, from small ones that can hold a small piece of jewelry or the like to large ones that may contain refrigerators or even larger items.

Many boxes, such as moving boxes, are sold in a flat form that must be opened up and assembled, often with tape. However, the boxes must be disassembled (e.g., removing the tape) in order to be stored in a flattened, less bulky configuration.

Additionally, there are current efforts to reduce the usage of disposable plastic bags due to their harmful impacts on the environment. One solution to this waste production is the adoption of the "reusable tote bags" that are typically made of fabric or soft plastic. While such reusable bags produce less waste, they provide little structural support for contained goods and may be unstable when set down on a surface as compared to a box with rigid sides.

Some boxes, when assembled, are designed to be folded flat when not in use without requiring disassembly. One example of such a box is described in U.S. Pat. No. 3,565,325, which presents a box that can be collapsed into a flat configuration and then folded back out to form a box when desired. However, the sides of this box project outward when folded flat, leading to a larger profile that is more difficult to carry and takes up more space when being stored. Such larger profile when collapsed make these boxes (which may include an attached handle to be used as a tote) less desirable because they are bulkier to carry when in the collapsed state.

Accordingly, it may be desirable to provide a storage box or box-like tote that can be easily collapsed into a flat configuration having a small profile, and easily expanded back to a box form suitable for carrying or storing items therein.

SUMMARY OF EXEMPLARY EMBODIMENTS OF THE DISCLOSURE

Embodiments of the disclosure can provide a collapsible box that facilitates folding of the box into a flattened configuration having a profile the same size as the sides of the box. The box includes two main face panels, two side pieces, each formed of two side panels having a vertical crease between them, a lower bottom panel having a longitudinal crease and cutouts adjacent to the side panels, bottom flaps attached to the lower edges of the side panels, and an upper bottom panel affixed to the lower edge of a main face panel that folds over the lower bottom panel and bottom flaps to provide structural rigidity.

The box can be easily collapsed by raising the upper bottom panel and bottom flaps, and pushing the creases on the side pieces and lower bottom panel inward. The vertical creases between the side panels extend inward during the collapsing process to extend within the cutouts as the lower bottom panel folds upward. This results in a flattened box having a profile that is no larger than the size of a main face panel.

The flattened box can be opened by first pulling the main face panels away from each other such that the side pieces and lower bottom panels are essentially flat. The bottom flaps can then be folded downward to rest on the lower bottom panel, covering some or all of the side cutouts on the lower bottom panel. The upper bottom panel can then be folded down to rest on the bottom flaps and lower bottom panel, such that it fills the entire lower portion of the box. The bottom flaps facilitate sealing of the bottom of the assembled box structure along the sides of the box, as well as providing additional support to the bottom of the box.

The box can optionally be formed from a single blank of cardboard or similar material, and can optionally be provided with handles or a lid. Flaps can be provided on an edge of the bottom flap and either on a side edge of a face panel or a side panel to facilitate assembly by adhering these flaps to the adjacent panels to form the box structure. Adhering of the flaps to the panels can be achieved using, e.g., tape, glue, staples, an adhesive coating on the surface of the flaps, and the like.

Collapsible boxes according to the present disclosure can be formed from a variety of sheet materials such as, e.g., cardboard, corrugated cardboard, poster board, plastic sheeting, and the like. The material used to make the box can be any material provided in thin sheet form that is substantially rigid but can hold a crease between adjacent panels that can be folded and unfolded repeatedly.

In further embodiments, a blank (e.g., a pre-cut or printed sheet) made of cardboard or similar material can be provided, in which the blank is designed with sections configured to be assembled into a collapsible box as described herein.

In some embodiments, an optional handle arrangement can be attached to the upper edge of each face panel. The handles can include multiple folded layers to add thickness for strength and comfort. In further embodiments, other handle configurations can be provided, such as cutouts near the top of the sides of the box. In still further embodiments, the collapsible box can be provided with no handles.

In other embodiments, a lid can be provided for the box. Such lid can be attached to the top edge of a face panel by a crease and have a rim on the other three sides, such that the lid can be folded over the top opening. In further embodiments, a separate lid can be provided with the box.

BRIEF DESCRIPTION OF THE DRAWINGS

Further objects, features and advantages of the present disclosure will become apparent from the following detailed description taken in conjunction with the accompanying figures showing illustrative embodiments, results and/or features of the exemplary embodiments of the present disclosure, in which.

While the present disclosure will now be described in detail with reference to the figures, it is done so in connection with the illustrative embodiments and is not limited by the particular embodiments illustrated in the figures. It is intended that changes and modifications can be made to the described embodiments without departing from the true scope and spirit of the present disclosure as defined by the appended claims.

DETAILED DESCRIPTION OF EXEMPLARY EMBODIMENTS

Figure 1:
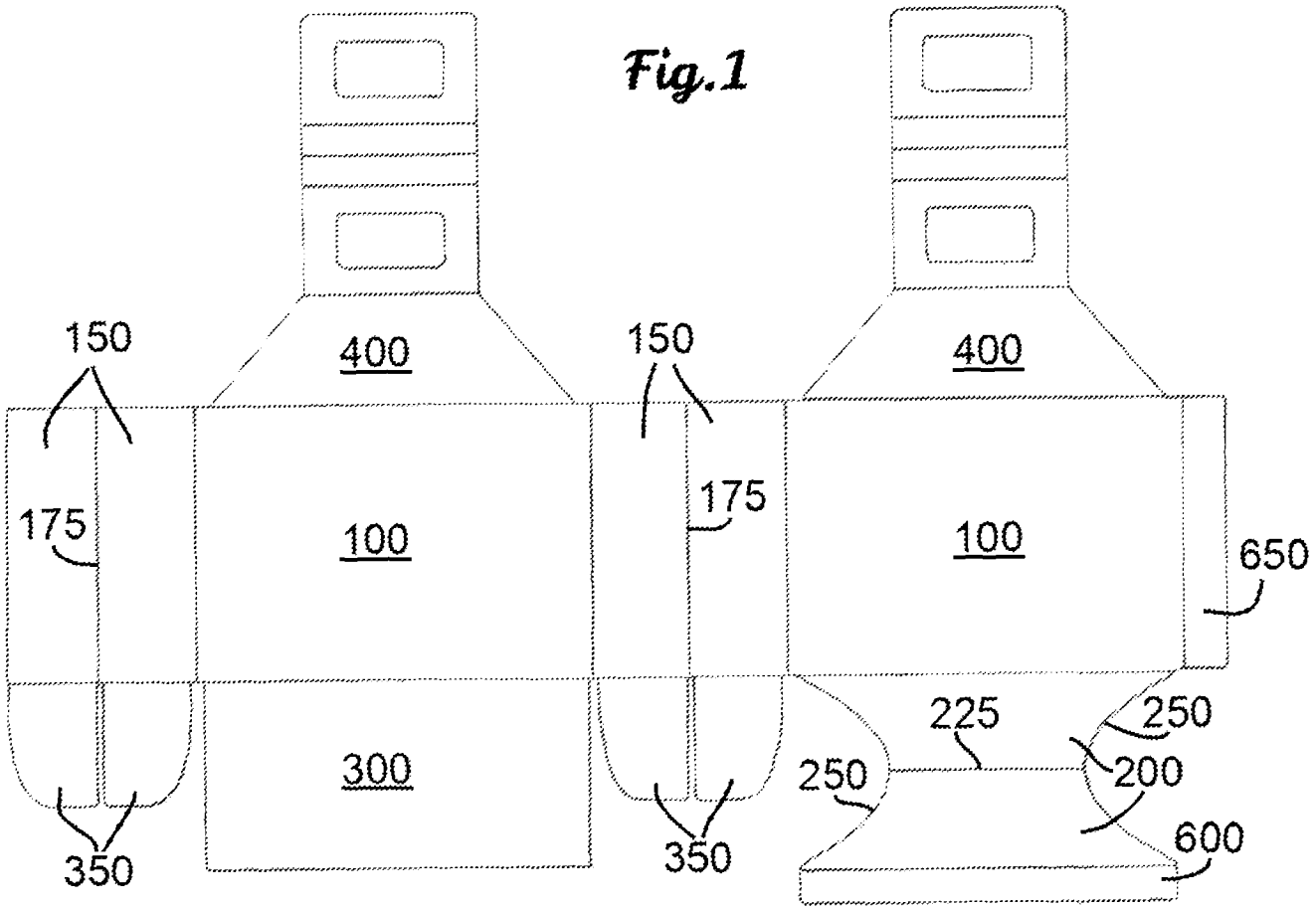
FIG. 1 shows the structural components of the collapsible box, illustrated as an exemplary single-piece cutout pattern that includes optional handles.

Embodiments of the disclosure can provide a rigid storage box or box-like tote that can be easily collapsed into a flat configuration having a small profile, and easily expanded back to a box form suitable for carrying or storing items therein. An illustration of the components of such a box according to embodiments of the disclosure is shown in FIG. 1. In this figure, the box is laid out in an optional unassembled single blank form that can be easily assembled to form the collapsible box structure. In other embodiments, the box may be provided in other pre-assembled forms or in two or more separate pieces to be assembled, as described in more detail herein.

Collapsible boxes according to the present disclosure can be formed from a variety of sheet materials, including but not limited to cardboard, corrugated cardboard, poster board, plastic sheeting, and the like. Paper-based materials such as cardboard can be used for common applications, but plastic sheet panels may be desirable to form a collapsible box that is more resistant to exposure to water and the environment. The material used to make the box can be any material provided in thin sheet form that is substantially rigid but can hold a flexible crease between adjacent panels that can be folded and unfolded repeatedly.

The collapsible box includes two face panels 100 (e.g., a front panel and a rear panel) having substantially the same size and being substantially rectangular in shape, and two side pieces that are also substantially rectangular in shape, where each side piece is formed of two side panels 150 having a vertical crease or fold 175 between them. The collapsible box further includes an upper bottom panel 300 that is attached to the lower edge of a face panel 100 by a crease (solid line), and a lower bottom that includes two lower bottom panels 200 with a longitudinal crease 225 between them. The lower bottom includes a bottom cutout 250 formed on each end of the lower bottom adjacent to the side panels 150. The face panels 100, side panels 150, and upper bottom panel 300 are preferably substantially rectangular in shape, with the width of the face panel 100 being greater than the width of each side piece (i.e., the width of two side panels 150).

A bottom flap 350 is attached to the lower edge of each side panel 150 by a crease indicated by the solid line between these components in FIG. 1. The width of each bottom flap is substantially the same as the width of the adjacent side panels 150, as shown in FIG. 1, and the ends of the bottom flaps 350 away from the side panels 150 can optionally be somewhat narrower, e.g., having a curved outer contour, as described in more detail herein below. The length of each bottom flap 350 is preferably less than half the width of the face panels 100, but longer than the height of the side cutouts 250, i.e., longer than the distance between end of a face panel 100 and the nearest end of the crease 225 separating the two lower bottom panels 200. These size criteria are explained in more detail below in the description of the assembly/collapsing of the box structure.

An optional handle arrangement 400 can be attached to the upper edge of each face panel 100. Details of such a handle arrangement 400 and other handle and lid options are described in more detail below.

Figure 2:
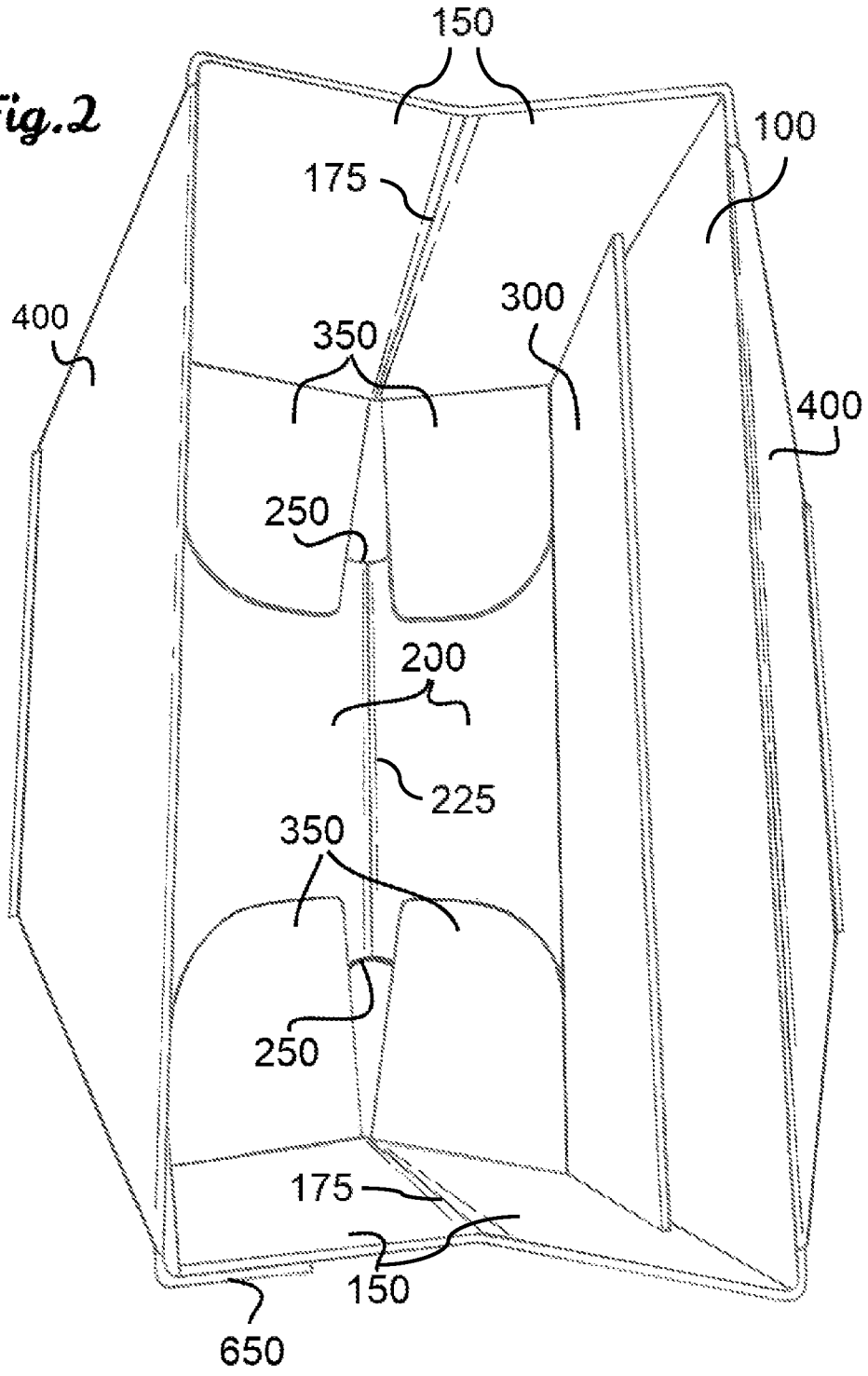
FIG. 2 is a top perspective view of the collapsible box in a partially collapsed configuration.

In the exemplary embodiment illustrated in FIG. 1, two optional assembly flaps 600, 650 can be provided to facilitate easy assembly of the box from the single blank shown in FIG. 1. A top perspective view of an assembled box that is partially collapsed is shown in FIG. 2. To assemble this box, right-angle creases are made between the face panels 100 and the adjacent side panels 150. The assembly flap 650 is then creased and adhered to the cut edge of side panel 150 (e.g., the leftmost edge in FIG. 1), as illustrated in FIG. 2. In a further embodiment, the assembly flap 650 can be provided along the leftmost side edge of the side panel 150 in FIG. 1, such that it can be folded and adhered to the rightmost edge of face panel 100 during assembly.

Figure 4:
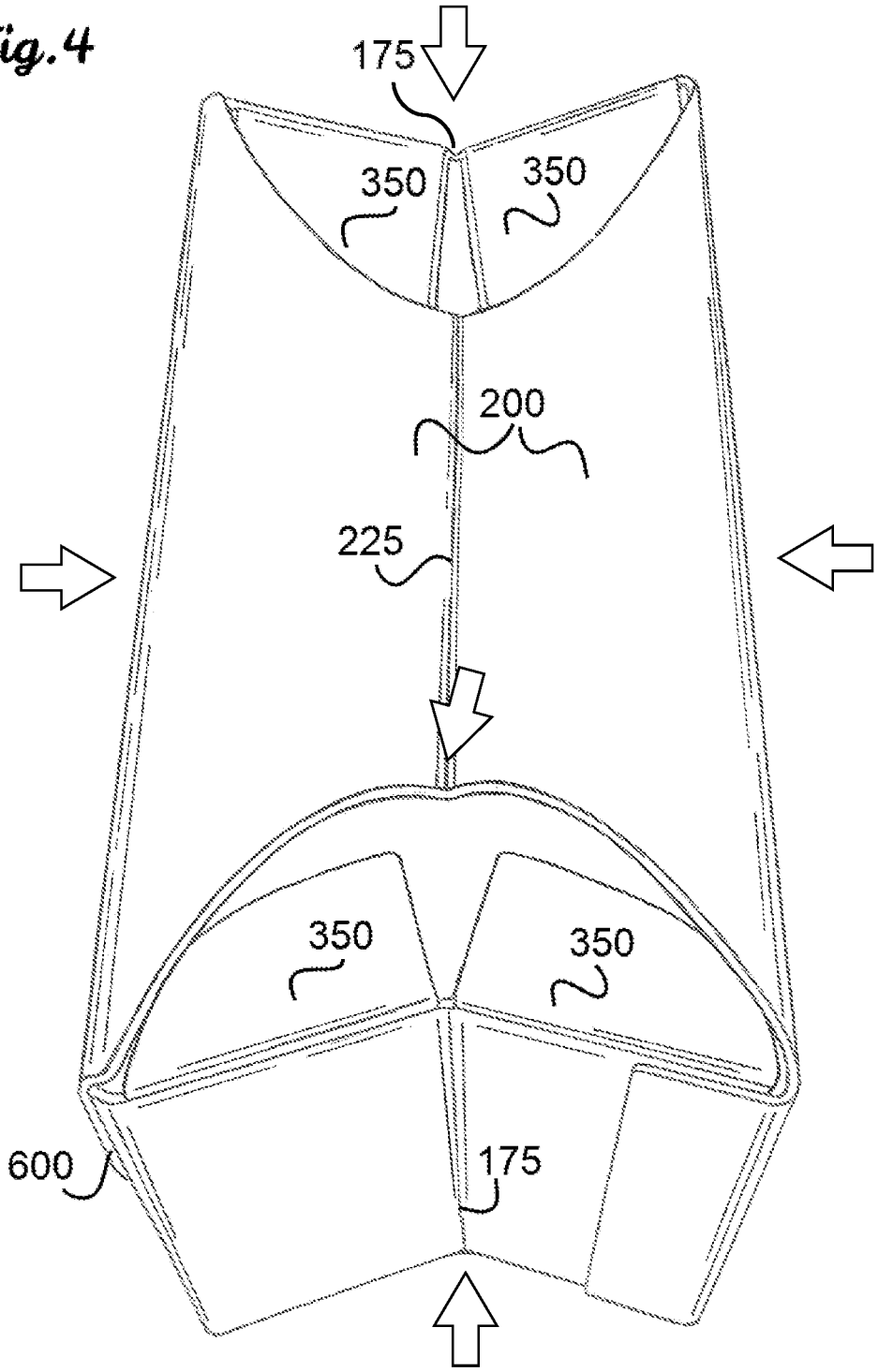
FIG. 4 is a bottom perspective view of the collapsible box illustrating the collapsing procedure.

Lower bottom panels 200 are laid flat along the bottom of the box structure, below upper bottom panel 300, and assembly flap 600 is adhered to the lower edge of face panel 100 where it meets bottom panel 200. The end of assembly panel 600 can be seen adhered to the bottom of face panel 100 in FIG. 4. In a further embodiment, the assembly flap 600 can be folded over against the upper surface of the lower bottom panel 200, and the upper surface of assembly flap 600 can be adhered to the lower surface of the upper bottom panel 300, such that the crease between the assembly flap 600 and the lower bottom panel 200 lies along the crease between the face panel 100 and the upper bottom panel 300.

The assembly flaps 600, 650 can be adhered to the edges of the adjacent panels using any conventional adherence techniques including, e.g., glue, tape, or staples. The assembly flaps 600, 650 can also be provided with a sticky adhesive over at least part of the surface, optionally covered with a removable plastic strip, such that the plastic strip can be removed and the assembly flaps 600, 650 can be simply pressed against the appropriate adjacent panel to adhere thereto and assemble the box more easily.

As shown in FIG. 2, the assembled collapsible box according to embodiments of the present disclosure includes two face panels 100 attached at their lateral ends to two side pieces at a crease in the box material, where each side piece is formed from two side panels 150 with a central vertical crease, arranged in a substantially rectangular shape. A lower box bottom is formed from two lower bottom panels 200 having a longitudinal bottom crease 225 between them, and this box bottom is attached to the bottom edges of the two face panels 100 by a flexible crease. Each lower bottom panel 200 has about the same width as each side panel 150, such that the lower box bottom extends flat between the face panels 100 when the creases between each pair of side panels 150 (e.g., the sides of the box) are flat. A bottom flap 350 is connected to the bottom edge of each of the four side panels 150 by a crease, and these bottom flaps 350 lie partially over the lower bottom panels 200, at least partially covering the bottom cutouts 250. Finally, an upper bottom panel 300 is affixed to the bottom edge of one face panel 100 by a flexible crease, and lies over both the bottom flaps 350 and the lower bottom panels 200. The upper bottom panel 300 is preferably sized such that it fills substantially the entire rectangular opening formed by the face panels 100 and the side panels 150, when the angle between each face panel 100 and the adjacent side panels 150 is about 90 degrees, and the crease between each adjacent pair of side panels 150 is substantially flat. Optional handle arrangements 400 are shown in FIG. 2 as being folded downward along the outside of the face panels 100 to better show the interior structure of the partially collapsed box.

The upper bottom panel 300 is shown folded upwards towards the adjacent face panel 100 in FIG. 2. To complete assembly of the collapsible box, this upper bottom panel 300 is folded down to a horizontal position, so it lies over the bottom flaps 350 and lower bottom panels 200, as shown in the perspective view of FIG. 3. This final assembly step adds structural rigidity to the box assembly. For example, the edges of the upper bottom panel 300 press against the lower edges of side panels 150 to straighten both the side creases 175 and bottom crease 225, thereby maintaining flat sides and a supported flat bottom of the assembled box. The upper bottom panel 300 also provides a monolithic base for the interior of the assembled box with no openings or cracks that could allow small items to fall out. The bottom flaps 350 also help to fill any gap that would be present between the upper bottom panel 300 and the side panels 150 when the box is assembled and expanded.

Bottom flaps 350 also facilitate sealing of the bottom of the assembled box structure. Because they are attached to the bottom edges of the side panels 150, the bottom flaps 350 cover any gap that would exist between the upper bottom panel 300 and the side panels 150. These bottom flaps 350, which lie between the lower bottom panels 200 and the upper bottom panel 300, also provide additional support for the bottom of the box structure, reducing the likelihood of the box bottom tearing, warping, or falling apart when heavy objects are placed inside. As noted earlier, the length of the bottom flaps 350 are preferably longer than the width of the bottom cutouts 250, so that they rest partially on the lower bottom panels 200 and cover some or all of the open area of the bottom cutouts 250 when assembled.

The bottom flaps 350 are preferably shorter than half the width of the face panels 100, such that they do not overlap the bottom flaps 350 on the opposite side of the box when folded down as shown in FIG. 2. Such overlap would not impair functionality of the collapsible box, but it may lead to extra thickness where the opposite bottom flaps 350 would overlap in the center, and an uneven bottom surface. Additionally, the length of the bottom flaps are preferably shorter than the height of the side panels 150, such that they do not protrude above the top edge of the side panels 150 when they are folded upwards in the collapsed state.

The bottom flaps 350 illustrated in FIGS. 1 and 2 have a curved edge at the end away from side panels 150 and adjacent to the face panels 100. Such curved contour can reduce friction against the face panels 100 when the bottom flaps 350 are folded up and down to collapse and open up the box structure, respectively. In further embodiments, the bottom flaps 350 can be rectangular in shape, or have other shapes as desired, as long as they substantially cover the bottom cutouts 250 and partially overlap the lower bottom panels 200 when folded downwards. The central edges of the bottom flaps 350 are preferably straight such that they align with the adjacent bottom flaps 350 when folded down, thereby covering the bottom cutouts 250 and providing a completely covered bottom layer below the upper bottom panel 300. However, such complete bottom coverage below the upper bottom panel is not essential for the functioning of the collapsible box, and in further embodiments the bottom flaps 350 can be provided in other shapes and contours as well. The essential structural features of the bottom flaps 350 are that they are connected to the lower edges of the side panels 150 across substantially their entire width to prevent openings in the box bottom, and that they lie over at least a portion of the lower bottom flaps 200 such that they do not drop loose from the bottom of the box in the assembled state.

Figure 3:
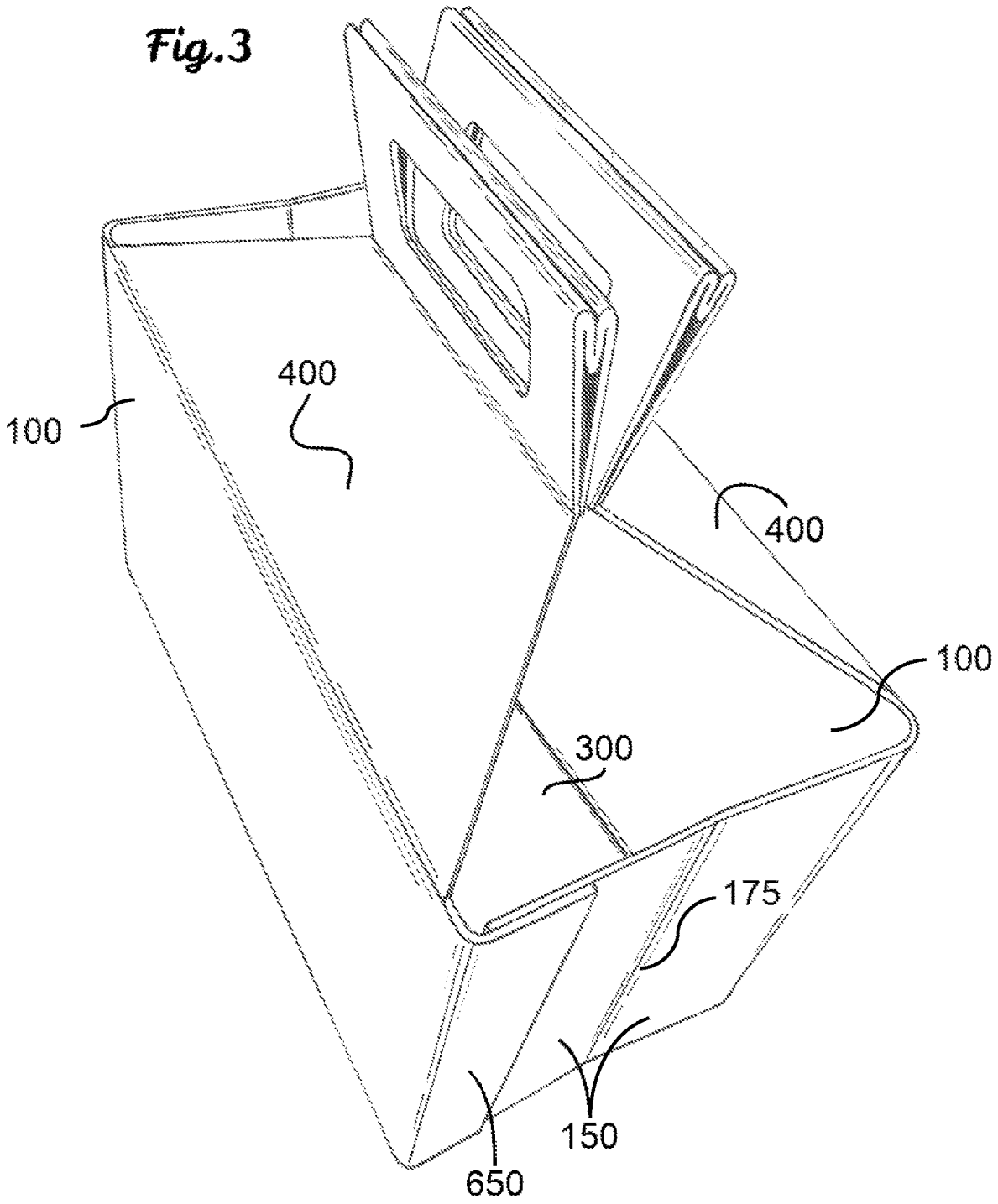
FIG. 3 is a top perspective view of the collapsible box in a fully opened configuration with optional handles such that it can be used as a tote.

FIG. 3 illustrates the completely assembled box structure according to certain embodiments of the present disclosure, including optional handle arrangements 400. This embodiment provides a rigid box structure where the upper bottom panel helps to maintain a rigid rectangular shape of the box, such that each pair of side panels 150 form a substantially planar side with a flattened side crease 175 between them. The optional handle arrangements 400 are attached along the full upper edges of the face panels 100, providing stability and strength when the box is being carried with items inside.

To collapse the assembled box, the upper bottom panel 300 is first folded upwards and against the adjacent face panel 100, as shown in FIG. 2. The four bottom flaps 350 are then folded upwards to lie vertically against the adjacent side panels 150. Finally, as shown in the bottom perspective view of FIG. 4, the side creases 175 and bottom crease 225 are simultaneously pushed inward (as indicated by the hollow arrows) such that the face panels 100 approach each other, with the side panels 150 and lower bottom panels 200 folded between them.

Figure 5:
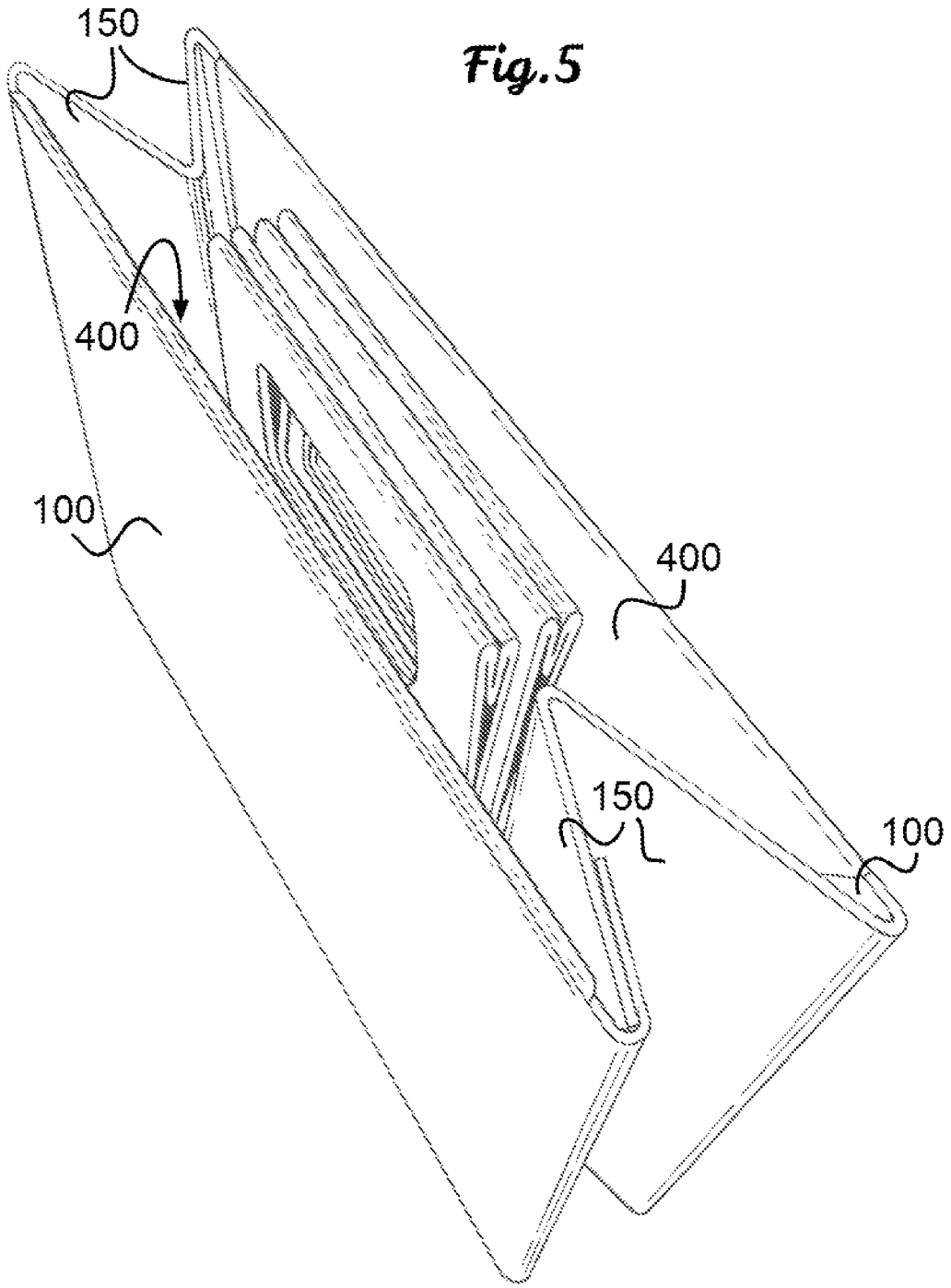
FIG. 5 is a top perspective view of the collapsible box in a collapsed configuration with optional handles folded inside the flattened box.

The collapsed box is illustrated in FIG. 5, although it is not pressed completely flat in this figure for clarity. The optional handle arrangements 400 are shown folded inward between the face panels 100. In this configuration, the collapsed box presents a flat profile that is no larger than the size of the face panels 100, which is advantageous for carrying and storing the box in a collapsed state.

To open up the box from this collapsed state, the face panels 100 are pulled away from each other to form an open rectangular configuration and straighten out both the lower bottom panels 200 and the pairs of adjacent side panels 150. The bottom flaps 350 are then folded downward to lie against the upper surface of the lower bottom panels 200. Finally, the upper bottom panel 300 is folded downward to lie against the bottom flaps 350 and lower bottom panels 200, to add structural rigidity and provide a continuous bottom surface for the box interior.

Figure 6:
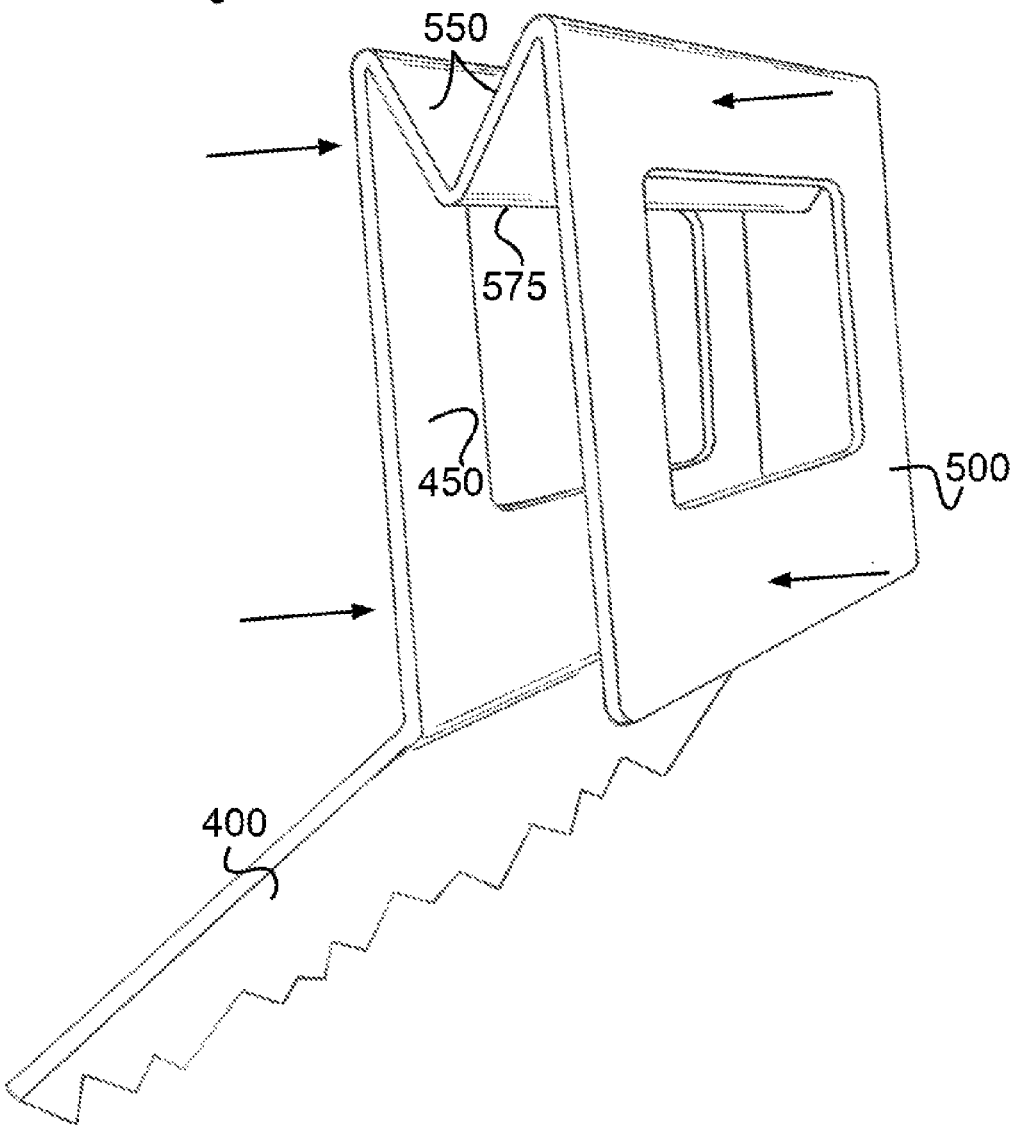
FIG. 6 is an illustration of an exemplary reinforced handle arrangement that can be used with the collapsible box.

FIG. 6 provides a detailed illustration of an optional handle arrangement 400 that can be used together with embodiments of the present disclosure. Such handle arrangement allows embodiments of the collapsible box described herein to be used as a convenient tote box to carry items placed in the box. The handle arrangement 400 further includes two handle panels 450, 500, each having a central cutout, and two grip panels 550 attached to the handle panels 450, 500 by creases and separated by a handle crease 575. This configuration is shown in a flattened form in FIG. 1. The components of the handle arrangement 400 can be folded along creases, as indicated by the arrows in FIG. 6, to provide flat thicker handles as shown, e.g., in FIG. 3.

The exemplary handle arrangement 400 provides certain advantages over other types of handles, such as a handle merely having a single handle panel 450 with a cutout, or even a handle having two handle panels 450, 500 with cutouts but no grip panels 550 between them. For example, the grip panels 550 add additional strength to the upper portion of the handle above the cutout, to help reduce risk of tearing or failure of the handle material when carrying heavy items in the box.

Further, the folded grip panels 550 add some thickness to the upper portion of the handle arrangement where it would be held by fingers inserted through the cutouts, thereby providing a more comfortable grip for a user carrying the collapsible tote box. Also, the width of the grip panels 550 can be selected such that the handle crease 575 between them extends a bit into the upper portion of the cutout region of the handle arrangement 400 when the handle is folded as shown, e.g., in FIG. 3. In this manner, a user's hand would contact the handle crease 575 rather than the raw-cut upper edges of the cutouts when gripping the handle. Because the upper edge of the cutout bears all the weight of the box and its contents when the box is carried by the handle arrangement 400, having this smooth handle crease 575 contact the hand (as well as the added thickness provided by the grip panels 550) improves both comfort and strength of the handle arrangement 400.

The exemplary embodiments illustrated herein include handle arrangements 400 attached to the face panels 100. In further embodiments, a collapsible box can be provided without such handle arrangements 400, such that the upper edges of face panels 100 are simply cut edges. Such handleless boxes may be preferable for certain storage and packing uses of the box. In still further embodiments, other types of box handles known in the art may be attached to or formed as part of the collapsible box described herein. For example, a simple rectangular or oval-shaped cutout can be provided near the upper end of the sides of the box to facilitate grabbing and carrying the box. Other types of handle arrangements may be attached to or formed as part of the collapsible box configuration described herein, such as a rope material, formed plastic grips, or the like that can be affixed to the body of the collapsible box.

In other embodiments, a lid or cover can be provided for the collapsible box. For example, a conventional separate lid that can be sized to just fit over the box can be provided, which may be formed of the same material as the collapsible box or a different material. Such removable box lids, which typically include a rectangular surface and short perpendicular edges, can be sized to securely fit over the top edges of the collapsible box and may be desirable when using the collapsible box, e.g., for shipping or storage of items.

In still further embodiments, one of the handle arrangements 400 in the blank shown in FIG. 1 can be omitted and the second one replaced with a rectangular lid assembly that is attached to the upper edge of face panel 100 by a crease. This rectangular lid (not illustrated) can also have rim panels provided on the three free edges of the lid and attached thereto by creases, with appropriate tabs, such that the rims can be folded up and locked together to form a cover for the box. This type of lid is attached along one side of the top of the box, with a rim provided over the other three sides of the lid that fit over the upper edges of the box when the lid is folded over. Such an attached lid is known in the art, e.g., in certain cardboard "banker's boxes," and can be convenient when the collapsible box is being used to store items therein.

The foregoing merely illustrates the principles of the present disclosure. Various modifications and alterations to the described embodiments will be apparent to those skilled in the art in view of the teachings herein. It will thus be appreciated that those skilled in the art will be able to devise numerous techniques which, although not explicitly described herein, embody the principles of the present disclosure and are thus within the spirit and scope of the present disclosure.

What is claimed is:

1. A collapsible box, comprising:

a front panel and a back panel, a first side piece joined to a left end of the front panel and to a left end of the back panel by flexible creases, a second side piece joined to a right end of the front panel and to a right end of the back panel by flexible creases, a lower bottom panel joined to a lower edge of the front panel and to a lower edge of the back panel by flexible creases, two bottom flaps joined to a lower edge of each side panel by a flexible crease, and an upper bottom panel joined to the lower edge of the front panel by a flexible crease, wherein the front panel and the back panel each have a flat lower edge and a same width, wherein the first side piece and the second side piece each have a flat lower edge and a same width that is not wider than the width of the front panel, wherein each of the first and second side pieces comprises two side panels joined by a flexible vertical crease halfway between the adjacent front panel and the adjacent back panel, wherein the lower bottom panel comprises a flexible longitudinal crease that is parallel to the front and back panels, wherein the lower bottom panel further comprises a cutout provided at each end thereof adjacent to a side panel, wherein each cutout extends along a full width of the end of the lower bottom panel adjacent to the side panels, wherein a length of the cutout between the vertical crease joining adjacent side panels and an end of the cutout located at the longitudinal crease is at least as long as a width of each side panel, wherein a width of each bottom flap where it is joined to an adjacent side panel is the same as the width of the adjacent side panel, wherein a length of each bottom flap is at least as long as the length of the cutout, wherein each bottom flap is configured to lie over a portion of the lower bottom panel and cover at least a portion of the adjacent cutout, wherein the upper bottom panel is configured to lie over the bottom flaps and the lower bottom panel, has a length that is the same as the width of the front panel, and has a width that is the same as the width of the side pieces, and wherein the collapsible box is configured such that when the collapsible box is collapsed into a flattened configuration, the upper bottom panel lies flat against the front panel, and each of the upper bottom panel, the lower bottom panel, the first side piece, and the second side piece lie fully between the front panel and the back panel.

2. The collapsible box of claim 1, wherein the box is made from a cardboard material.

3. The collapsible box of claim 1, wherein the box is made from a thin sheet that is rigid and can hold a flexible crease between adjacent panels.

4. The collapsible box of claim 1, wherein the collapsible box is formed from a single blank of a thin sheet material.

5. The collapsible box of claim 4, wherein the collapsible box further comprises at least one assembly flap provided along at least one of a vertical edge of the side panel, a vertical edge of the front panel, a vertical edge of the back panel, or an edge of the lower bottom panel, to facilitate assembly of the collapsible box from the single blank.

6. The collapsible box of claim 5, wherein the at least one assembly flap is configured to be affixed to an adjacent panel by at least one of tape, glue, an adhesive material, or staples.

7. The collapsible box of claim 1, wherein each bottom flap is rectangular.

8. The collapsible box of claim 1, wherein each bottom flap comprises a curved edge along at least a portion of a lateral side thereof that is proximal to at least one of an adjacent front panel or an adjacent back panel.

9. The collapsible box of claim 1, further comprising a handle arrangement.

10. The collapsible box of claim 9, wherein the handle arrangement comprises a further cutout provided through an upper central portion of each of the first and second side panels.

11. The collapsible box of claim 9, wherein the handle arrangement comprises a handle panel joined to each of the front and back panels by a flexible handle crease, and wherein each handle panel comprises at least one cutout provided through a distal portion thereof.

12. The collapsible box of claim 11, wherein each handle panel comprises two cutouts with a flexible crease between them, such that when the crease is folded over the two cutouts superimpose thereby forming a thicker portion of the handle panel surrounding the cutouts.

13. The collapsible box of claim 12, wherein each handle panel further comprises two grip panels having substantially the same width and located between the two cutouts, wherein the two grip panels are joined to each other and to the portions of the handle panel containing the two cutouts by flexible creases, wherein the grip panels are configured to be folded in an M shape such that they lie between the portions of the handle panel containing the two cutouts, and wherein the flexible crease between the two grip panels is configured to extend below an upper edge of each of the two cutouts when folded in an M shape to provide a smooth creased surface within and adjacent to the upper edge of the two cutouts.

14. The collapsible box of claim 1, further comprising a lid arrangement configured to fit at least partially over an upper opening of the collapsible box, wherein the lid arrangement is affixed to the collapsible box.

15. The collapsible box of claim 1, wherein the box is configured to collapse into a substantially flat form having a profile no larger than a profile of the front panel.

16. The collapsible box of claim 1, wherein the box is configured to collapse by performing the following steps:

a) folding the upper bottom panel upward such that it lies flat against the front panel;

b) folding each of the bottom flaps upward such that they lie flat against the adjacent side panels; and c) simultaneously folding the vertical creases of the side panels inward and the longitudinal crease of the lower bottom panel upward such that the side panels and the lower bottom panel are folded in half between the front panel and the back panel, wherein the folded side panels extend into the cutouts on the lower bottom panel.

17. A blank configured to be assembled into a collapsible box, wherein the assembled collapsible box comprises:

a front panel and a back panel, a first side piece joined to a left end of the front panel and to a left end of the back panel by flexible creases, a second side piece joined to a right end of the front panel and to a right end of the back panel by flexible creases, a lower bottom panel joined to a lower edge of the front panel and to a lower edge of the back panel by flexible creases, two bottom flaps joined to a lower edge of each side panel by a flexible crease, and an upper bottom panel joined to the lower edge of the front panel by a flexible crease, wherein the front panel and the back panel each have a flat lower edge and a same width, wherein the first side piece and the second side piece each have a flat lower edge and a same width that is not wider than the width of the front panel, wherein each of the first and second side pieces comprises two side panels joined by a flexible vertical crease halfway between the adjacent front panel and the adjacent back panel, wherein the lower bottom panel comprises a flexible longitudinal crease that is parallel to the front and back panels, wherein the lower bottom panel further comprises a cutout provided at each end thereof adjacent to a side panel, wherein each cutout extends along a full width of the end of the lower bottom panel adjacent to the side panels, wherein a length of the cutout between the vertical crease joining adjacent side panels and an end of the cutout located at the longitudinal crease is at least as long as a width of each side panel, wherein a width of each bottom flap where it is joined to an adjacent side panel is the same as the width of the adjacent side panel, wherein a length of each bottom flap is at least as long as the length of the cutout, wherein each bottom flap is configured to lie over a portion of the lower bottom panel and cover at least a portion of the adjacent cutout, wherein the upper bottom panel is configured to lie over the bottom flaps and the lower bottom panel, has a length that is the same as the width of the front panel, and has a width that is the same as the width of the side pieces, and wherein the collapsible box is configured such that when the collapsible box is collapsed into a flattened configuration, the upper bottom panel lies flat against the front panel, and each of the upper bottom panel, the lower bottom panel, the first side piece, and the second side piece lie fully between the front panel and the back panel.

18. The blank of claim 17, wherein the box is made from at least one of a cardboard material, or a thin sheet that is rigid and can hold a flexible crease between adjacent panels.

19. The blank of claim 17, further comprising a handle arrangement that is at least one of joined to or formed as part of at least one of the front panel, the back panel the left side piece, or the right side piece.

20. The blank of claim 17, wherein the blank further comprises at least one assembly flap provided along at least one of a vertical edge of the side panel, a vertical edge of the front panel, a vertical edge of the back panel, or an edge of the lower bottom panel, to facilitate assembly of the collapsible box from the blank.

* * * * *